United States Patent [19]

Sampei

[11] Patent Number: 4,898,809

[45] Date of Patent: Feb. 6, 1990

[54] SILVER HALIDE PHOTOGRAPHIC LIGHT-SENSITIVE MATERIAL

[75] Inventor: Takeshi Sampei, Hino, Japan

[73] Assignee: Konica Corporation, Tokyo, Japan

[21] Appl. No.: 227,754

[22] Filed: Aug. 3, 1988

[30] Foreign Application Priority Data

Aug. 11, 1987 [JP] Japan ..... 62-201125
Aug. 11, 1987 [JP] Japan ..... 62-201126

[51] Int. Cl.[4] ..... G03C 1/84

[52] U.S. Cl. ..... 430/523; 430/522; 430/517; 430/531; 430/606; 430/950

[58] Field of Search ..... 430/950, 531, 523, 606, 430/522, 517

[56] References Cited

U.S. PATENT DOCUMENTS 3,567,458 3/1971 Milton ..... 430/592
4,409,322 10/1983 Ezaki et al. ..... 430/950
4,574,115 3/1986 Adachi et al. ..... 430/961
4,711,838 12/1987 Grzeskowiak et al. ..... 430/523
4,801,525 1/1989 Mihara et al. ..... 430/517

*Primary Examiner*—Paul R. Michl
*Assistant Examiner*—Thorl Chea
*Attorney, Agent, or Firm*—Jordan B. Bierman

[57] ABSTRACT

A silver halide photographic light-sensitive material is disclosed, which has high sensitivity and can be handled under bright safelight. The photographic material comprises a support bearing thereon photographic component layers including at least one silver halide emulsion layer containing a silver halide emulsion sensitized so as to have a maximum spectral sensitivity on the side of a wavelength shorter than at least 600 nm and at least one non-light-sensitive hydrophilic colloid layer arranged to the side of the silver halide emulsion layer opposite to the support. And at least one of the hydrophilic colloid layers contains a water-soluble dye having a maximum light-absorption within the wavelength region of not less than 700 nm.

9 Claims, No Drawings

SILVER HALIDE PHOTOGRAPHIC LIGHT-SENSITIVE MATERIAL

FIELD OF THE INVENTION

This invention relates to a silver halide photographic light-sensitive material and particularly to a highly sensitive silver halide photographic light-sensitive material which can be handled under bright safelight condition.

BACKGROUND OF THE INVENTION

Silver halide photographic light-sensitive materials have been handled either in the total darkness or in a safe light having a wavelength region to which the light-sensitive materials are not substantially sensitive, hereinafter simply called a safe light.

Generally, silver halide black-and-white light-sensitive materials and particularly those for industrial use such as those for photomechanical use have mostly been processed in a red safe light from the viewpoints of the characteristics of a light source used and working efficiency.

As have been well known so far in the art, among the light-sensitive materials for industrial use, matte films have been used for duplicating the drawings of machines or structures, maps and so forth, for halftoning aerial photographs by making use of a screen so as to enlarge the photographs or to make them into a composite picture or the like. The so-called 'matte film' is a film containing a large amount of matting agent in its layer so as to be opaque. The reason why a film is to be matted by adding a large amount of matting agent in its layer is that a retouch or correction can be made with a pencil or an ink and the retouched or corrected pencil or ink traces can be erased with a rubber eraser, after exposed and processed the film. Thereby, a retouch and write-on may be made on drawings. Accordingly, after exposing and processing such a matte film, it is used for retouching and writing on a drawing by retouching or erasing the traces and for subjecting to a diazo printing and a copying operation.

Generally, these matte films are also mostly handled under s red safe light condition. It is, therefore, usual that these matte films are sensitized to green sensitive regions.

As described above, in the case that an aerial photograph is enlarged upon making it halftoned by making use of a screen or in the like cases, the matte film should desirably have a relatively high sensitivity.

When exposing an image to light emitted from such an ordinary light source as a tungsten or halogen lamp, it is advantageous to make a light-sensitive material have a sensitivity to a relatively longer wavelength side, however, a red safe light is rather easier to handle the light-sensitive material than a green safe light.

In the meantime, there is a technology in which a photo-sensitive wavelength region intrinsic to silver halides can be widened to a long wavelength side by adding a certain kind of dyes into a silver halide emulsion, that is well known in the art as a spectral sensitization technology.

When handling a light-sensitive material in red light condition, usually the light-sensitive material is spectrally sensitized to a wavelength region not longer than 600 nm, that is, to a green region. As for the sensitizing dyes which are applicable to the sensitization to a green region, a variety of cyanine or merocyanine dyes are known.

In general, however, the more the sensitivity of a light-sensitive material is getting higher, the more the light quantity of a safe light is to be small. The working property is deteriorated. This fact may also applied to the case of using a light-sensitive material which is to be handled under red safe light conditions. There is a demand for embodying a light-sensitive material which may be handled under bright red safe light conditions from the viewpoint of working property. It is, however, the state of things that the sensitivity of such a light-sensitive material may not be increased.

SUMMARY OF THE INVENTION

It is an object of the invention to provide a silver halide photographic light-sensitive material which has a high sensitivity and can be handled under bright safelight conditions.

The above-mentioned object of the invention can be accomplished with a silver halide photographic light-sensitive material comprising a support bearing thereon a silver halide emulsion layer containing a silver halide emulsion having sensitized so as to have a maximum spectral sensitivity on the side of a wavelength shorter than 600 nm and a non-light-sensitive hydrophilic colloidal layer arranged to the upper side of the silver halide emulsion layer (that is, the opposite side to the support with respect to the emulsion layer), wherein at least one of the non-light-sensitive hydrophilic colloidal layers contains a water-soluble dye-stuff having an absorption maximum within the wavelength region of not less than 700 nm.

When a light-sensitive material is prepared by coating a non-light-sensitive hydrophilic colloidal layer containing a water-soluble dye having an absorption maximum within the wavelength region of not less than 700 nm, preferably with in the range between 700 nm and 800 nm, that is a water-soluble dye having an absorption maximum in an infrared region, to the upper side of a silver halide photographic emulsion layer so spectrally sensitized as to have a sensitization maximum to the side of wavelength shorter than 600 nm, that is a photographic emulsion layer spectrally sensitized to a green region, it was not expected at all that such a light-sensitive material is excellent in safety against red light and high in sensitivity. The above-described silver halide emulsion layers may be comprised of three or more layers, however, it is commonly sufficient to provide not more than two layers.

In the invention, a non-light-sensitive hydrophilic colloidal layer is arranged to the upper side of a silver halide emulsion layer, that is, to a position farther than the above-mentioned emulsion layer with respect to a support, and a water-soluble dye having an absorption maximum within the wavelength region of not less than 700 nm is contained in at least one of the above-mentioned non-light-sensitive hydrophilic colloidal layers. This non-light-sensitive hydrophilic colloidal layer containing the dye may be arranged adjacent to the above-mentioned silver halide emulsion layer, or to the upper side of the silver halide emulsion layer through an interlayer. It is also allowed to arrange the other non-light-sensitive hydrophilic colloidal layer to the upper side of the non-light-sensitive hydrophilic colloidsl layer containing the above-mentioned dye.

For the dyes which may be used in the invention, a cyanine dye, an azo dye and so forth may be used, however, a water-soluble dyes may be usefull from the viewpoint of eliminating the residual color after a light-sensitive material is processed.

The silver halide emulsions of the invention may be spectraly sensitized so as to have a sensitization maximum of not higher than 600 nm and, more preferably, from 500 to 600 nm.

The sensitizing dyes which may be used in the invention include, for example, cyanine and merocyanine dyes given in Japanese Patent Examined Publication Nos. 7828-1963, 392-1965, 10251-1968 and 22884-1968; British Pat. Nos. 815,172, 955,961, 955,912 and 142,228; U.S. Pat. Nos. 1,942,854, 1,950,876, 1,957,869, 2,238,231, 2,521,705 and 2,647,059; Japanese Patent Examined Publication Nos. 2606-1968, 3644-1969, 18106-1971, 18108-1971, 15032-1973, 33782-1974, 34252-1979 and 52574-1983; U.S. Pat. Nos. 2,839,403, 3,567,458 and 3,625,698; and so forth.

Typical examples of these sensitizing dyes include those represented by the following formulas I and II:

Formula I

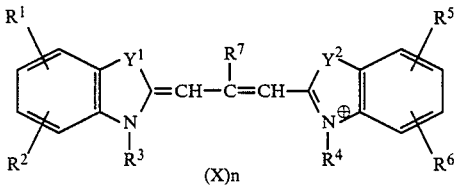

wherein $Y^1$ and $Y^2$ represent an oxygen atom or

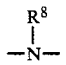

group; $R^1$, $R^2$, $R^5$, $R^6$ and $R^8$ represent a hydrogen atom, a halogen atom, a halogenoalkyl, a group of hydroxyl, cyano or nitro, a substituted or non-substituted group of alkyl, alkoxy, aryl, alkenyl, acyl, sulfonyl or alkoxycarbonyl; $R^3$ and $R^4$ represent a substituted or non-substituted group of alkyl, alkenyl or aryl; $R^7$ represents a hydrogen atom, a halogen atom or a group of allyl, aryl or cyano; X represents a counter ion capable enough to neutralize the electric charge of molecules; and n is an integer of 0 or 1.

Formula II

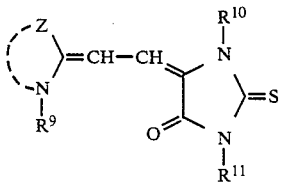

wherein Z represents a group of atoms necessary to complete a nucleus of oxazole, benzoxazole or naphthoxazole, and these nuclei may have a substituent in the carbon atom thereof. The typical examples of these substituents include a halogen atom, a non-substituted alkyl group having 1 to 6 carbon atoms, an alkoxy group having 1 to 4 carbon atoms, a hydroxy group, an alkoxycarbonyl group having 2 to 6 carbon atoms, an alkylcarbonyloxy, phenyl group having 2 to 5 carbon atoms, a hydroxyphenyl group and so forth.

$R^9$ represents a non-substituted or substituted alkyl group. The substituents include, for example, a group of hydroxy, sulfo, sulfonate or carboxy, a halogen atom such as those of fluorine and chlorine, a non-substituted or substituted alkoxy group having 1 to 4 carbon atoms, in which the alkoxy group may further be substituted with a sulfo or hydroxy group, an alkoxycarbonyl group having 2 to 5 carbon atoms, an alkylsulfonyl group having 1 to 4 carbon atoms, a sulfamoyl group a non-substituted or substituted carbamoyl group including a substituted carbamoyl group substituted with an alkyl group having 1 to 4 carbon atoms, a substituted phenyl group of which the substituents include, for example, a group of sulfo, carboxy, hydroxy or the like, a vinyl group, and so forth.

$R^{10}$ represents a group of alkyl, alkoxycarbonylalkyl, hydroxyalkyl, hydroxyalkoxyalkyl, carbamoylalkyl, hydroxyphenyl, hydroxyalkylphenyl, phenyl or alkoxyalkyl, or a substituent of $+CH_{2}\rightarrow_{n'}A$ or $+CH_{2}\rightarrow_{n'}O+CH_{2}\rightarrow_{n'}A$, wherein A represents a group of nitrile, alkylsulfonyl, sulfonamido or alkylsulfonylamino or an alkoxy group having 1 to 8 carbon atoms, and n' is an integer of 1 to 4.

The above-given groups each are allowed to have a substituent. For example, those having an alkyl component substituted with a halogen atom may also preferably be used.

$R^{11}$ represents an alkyl group having 1 to 6 carbon atoms, an alkoxy or alkylsulfon group having 1 to 6 carbon atoms, a non-substituted or substituted phenyl group, or a non-substituted or substituted pyridyl group. In the case of the substituted phenyl or substituted pyridyl group, the substituents include an alkyl group such as, preferably, those having 1 to 4 carbon atoms, e.g., a group of methyl, ethyl or the like, an alkoxy group such as, preferably, those having 1 to 4 carbon atoms, e.g., a group of methoxy, ethoxy or the like, a group of alkylsulfon or sulfon, an atom of chlorine or fluorine, or a carboxyl group.

The compounds represented by Formula I may preferably be represented by the following formula I-a, I-b or I-c.

Formula I-a

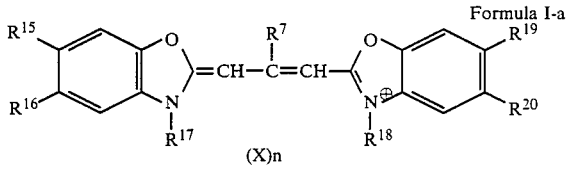

Formula I-b

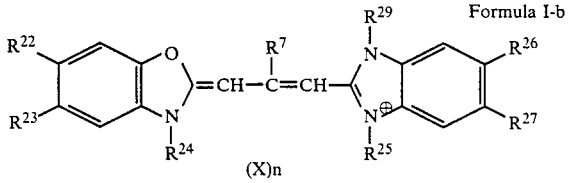

Formula I-c

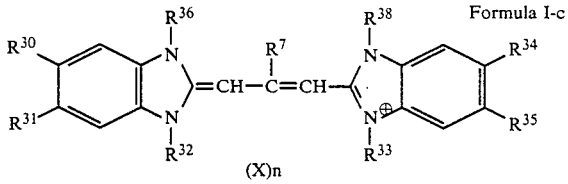

wherein $R^{15}$, $R^{16}$, $R^{19}$, $R^{20}$, $R^{22}$, $R^{23}$, $R^{26}$, $R^{27}$, $R^{29}$, $R^{30}$, $R^{31}$, $R^{34}$, $R^{35}$ and $R^{36}$ each represent a hydrogen atom, a halogen atom, a alkyl halide group or a group of hydroxyl, alkyl, alkoxy, aryl, alkenyl, acyl, cyano, nitro, sulfonyl or alkoxycarbonyl. Among them, each group of alkyl, alkoxy, aryl, alkenyl, acyl, sulfonyl and alkoxycarbonyl may be substituted. The substituents include, for example, a halogen atom, each group of hydroxyl, alkyl, alkoxy, alkyl halide group, amino, alkylamino, arylamino, furyl, pyrrolyl, thienyl, pyridine, piperidyl, piperazyl, morpholino, morpholinyl and quinolyl, and so forth.

In the formulas, $R^{17}$, $R^{18}$, $R^{24}$, $R^{25}$, $R^{32}$ and $R^{33}$ each represent a group of alkyl, alkenyl or aryl which is allowed to be substituted with a group of hydroxyl, sulfon or carboxyl. They include, for example, each group of methyl, ethyl, n-propyl, i-propyl, n-butyl, hydroxymethyl, hydroxyethyl, hydroxypropyl, sulfoethyl, sulfopropyl, sulfobutyl, carboxyethyl, carboxypropyl, benzyl, phenethyl, propenyl and so forth.

In the formulas, (X)n represents a counter ion capable enough of neutralizing the electric charge of molecules. Cations include, for example, an ion of hydrogen, sodium, potassium, triethylammonium, pyridinium or the like. Anions include, for example, an ion of chlorine, bromine, iodine or the like. As in the case that one of $R^{17}$ and $R^{18}$, $R^{24}$ and $R^{25}$, and $R^{32}$ and $R^{33}$ contains a sulfon group, if an intramolecular salt is produced, n is 0 and no counter ion is present.

The typical examples of the compounds represented by Formula I will be given below. It is, however, to be understood that the invention shall not be limited thereto.

[I-a]
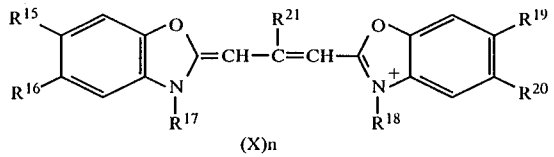
| | $R^{16}$ | $R^{15}$ | $R^{17}$ | $R^{18}$ | $R^{19}$ | $R^{20}$ | $R^{21}$ | (X)n |
|---|---|---|---|---|---|---|---|---|
| I-1 | —Cl | H | $-(CH_2)_3SO_3^{-}$ $^{3}SO_3^{-}$ | H | —Cl | $-C_2H_5$ | $N(C_2H_5)_3+$ | |
| 2 | —Cl | " | " | " | $-CH_3$ | —Cl | " | " |
| 3 | —Cl | H | " | " | H | 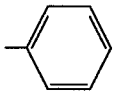 | " | " |
| 4 | 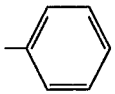 | " | " | " | " | 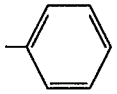 | " | " |
| 5 | 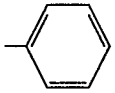 | " | " | " | " | 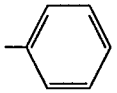 | " | 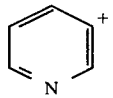 |
| 6 | $-CH_3$ | $-CH_3$ | " | " | $-CH_3$ | $-CH_3$ | H | $N(C_2H_5)_3+$ |
| 7 | $-OCH_3$ | H | " | " | H | $-OCH_3$ | $-C_2H_5$ | $Na^+$ |
| 8 | $-OCH_3$ | H | " | " | H | 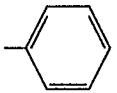 | " | $Na^+$ |
| 9 | —Cl | H | $-(CH_2)_4SO_3^{-}$ | $-(CH_2)_4SO_3^{-}$ | H | —Cl | " | $N(C_2H_5)_3+$ |
| 10 | 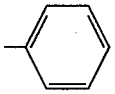 | H | " | " | H | 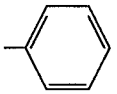 | " | 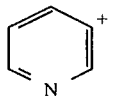 |

-continued

[I-b]

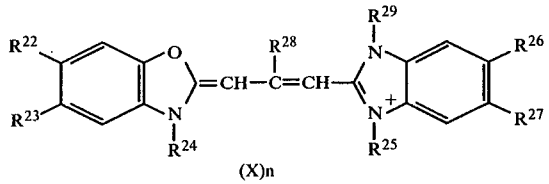

| | $R^{22}$ | $R^{23}$ | $R^{24}$ | $R^{25}$ | $R^{26}$ | $R^{27}$ | $R^{28}$ | $R^{29}$ | (X)n |
|---|---|---|---|---|---|---|---|---|---|
| I-11 | H | H | $-C_2H_5$ | $-C_2H_5$ | Cl | $-C_2H_5$ | H | $-C_2H_5$ | $I^-$ |
| 12 | " | " | " | $-(CH_2)_4SO_3^-$ | " | " | " | " | — |
| 13 | " | " | " | " | " | " | " | $-(CH_2)_3OH$ | — |
| 14 | " | " | " | " | " | " | " | $-(CH_2)_2O(CH_2)_2OH$ | — |
| 15 | " | " | " | " | " | " | " | $-CH_2-CH(OH)-CH_3$ | — |
| 16 | " | " | " | $-(CH_2)_3SO_3^-$ | H | $-CF_3$ | " | $-C_2H_5$ | — |
| 17 | " | " | " | $-(CH_2)_4SO_3^-$ | Cl | " | " | " | — |
| 18 | " | " | " | " | H | $-CN$ | " | " | — |
| 19 | " | " | " | " | Cl | CN | " | " | — |
| 20 | " | Cl | " | $-(CH_2)_3SO_3^-$ | Cl | " | " | — | |
| 21 | " | 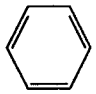 | $-(CH_2)_4SO_3^-$ | $-(CH_2)_4SO_3^-$ | Cl | CN | " | " | K+ |

[I-c]

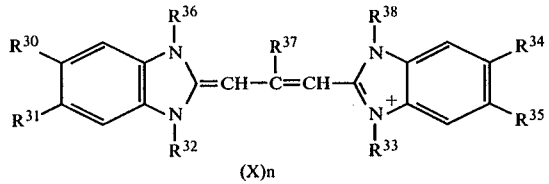

| | $R^{30}$ | $R^{31}$ | $R^{32}$ | $R^{33}$ | $R^{34}$ | $R^{35}$ | $R^{36}$ | $R^{37}$ | $R^{38}$ | (X)n |
|---|---|---|---|---|---|---|---|---|---|---|
| I-22 | H | Cl | $-C_2H_5$ | $-C_2H_5$ | H | Cl | $-C_2H_5$ | H | $-C_2H_5$ | $I^-$ |
| 23 | Cl | Cl | $-(CH_2)_3SO_3^-$ | $-(CH_2)_3SO_3^-$ | H | " | " | " | " | $Na^+$ |
| 24 | H | $-COOC_2H_5$ | $-C_2H_5$ | $-C_2H_5$ | H | $-COOC_2H_5$ | 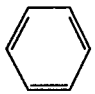 | " | 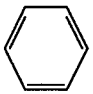 | 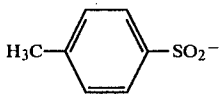 |

-continued

| | | | | | | | | | | |
|---|---|---|---|---|---|---|---|---|---|---|
| 25 | Cl | $-CF_3$ | " | " | Cl | $-CF_3$ | $-C_2H_5$ | " | $-C_2H_5$ | 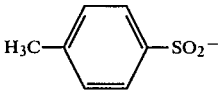 |
| 26 | H | $-SO_2N(CH_3)_2$ | " | " | H | $-SO_2N(CH_3)_2$ | " | " | " | $ClO_4^-$ |
| 27 | H | $-CONH_2$ | " | " | H | $-CONH_2$ | " | " | " | $ClO_4^-$ |
| 28 | H | $-COOC_2H_5$ | $-(CH_2)_4SO_3^-$ | $-(CH_2)_4SO_3^-$ | H | $-COOC_2H_5$ | " | " | " | $K^+$ |
| 29 | H | $-COOC_4H_9(n)$ | " | " | H | $-COOC_4H_9(n)$ | " | " | " | $Na^+$ |
| 30 | H | $-CN$ | $-(CH_2)_3SO_3^-$ | $-(CH_2)_3SO_3^-$ | H | $-CN$ | " | " | " | $Na^+$ |
| 31 | H | $-SO_2N(CH_3)_2$ | " | " | H | $-SO_2N(CH_3)_2$ | " | " | " | $Na^+$ |
| 32 | H | 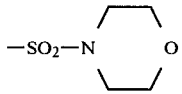 | $-C_2H_5$ | $-C_2H_5$ | H | 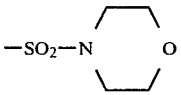 | " | " | " | $ClO_4^-$ |
| 33 | Cl | $-COOC_2H_5$ | $-(CH_2)_3SO_3^-$ | $-(CH_2)_3SO_3^-$ | Cl | $-COOC_2H_5$ | " | " | " | $Na^+$ |
| 34 | Cl | $-CN$ | " | " | Cl | $-CN$ | " | " | " | $Na^+$ |
| 35 | H | $-SO_2CH_3$ | " | " | H | $-SO_2CH_3$ | " | " | " | $Na^+$ |
| 36 | H | $-SO_2CF_3$ | $-C_2H_5$ | $-C_2H_5$ | H | $-SO_2CF_3$ | " | " | " | $I^-$ |

The typical examples of the compounds represented by Formula II will be given below. It is, however, to be understood that the invention shall not be limited thereto.

| substituent | $R^9$ | $R^{10}$ | $R^{39}$ | $R^{40}$ | $R^{41}$ | $R^{42}$ | $R^{43}$ | $R^{44}$ | $R^{45}$ |
|---|---|---|---|---|---|---|---|---|---|
| [II]-18 | $-(CH_2)_4-SO_3K$ | $-CF_2CO_2C_3H_7$ | H | H | H | H | H | H | H |
| -19 | $-(CH_2)_2SO_3K$ | $-CH_2CH_2OCH_3$ | H | H | H | H | H | H | H |
| -20 | $-(CH_2)_4SO_3K$ | $-CH_2CH_2OCH_3$ | H | Cl | H | H | H | H | H |
| -21 | $-CH_2COOH$ | $-CH_2CH_2CN$ | H | H | H | H | H | H | H |
| -22 | $-(CH_2)_3SO_3K$ | $-CH_2CH_2SO_2NH_2$ | H | $-OCH_3$ | H | H | H | H | H |
| -23 | $-(CH_3)_2SO_3K$ | $-CH_2CH_2CN$ | H | H | H | H | H | H | H |
| -24 | $-(CH_2)_2CH(CH_3)SO_3K$ | $-CH_2CH_2SO_2NH_2$ | H | 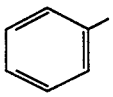 | H | H | H | H | H |
| -25 | $-(CH_2)_3SO_3K$ | $-CH_2CH_2CN$ | H | $-CH_3$ | H | H | H | H | H |
| -26 | $-(CH_2)_4SO_3K$ | $-CH_2CH_2NHSO_2CH_3$ | H | H | H | H | H | H | H |
| -27 | $-(CH_2)_2SO_3K$ | $-CH_2CH_2SO_2N(CH_3)_2$ | H | H | H | H | H | H | H |
| -28 | $-(CH_2)_4SO_3K$ | $-CH_2CH_2OCH_2CH_2CN$ | H | H | H | H | H | $-(CH_2)_4SO_3K$ | H |
| -29 | $-(CH_2)_2SO_3K$ | $-CH_2CH_2SO_2NH_3$ | H | H | H | H | H | H | H |
| -30 | $-(CH_2)_3SO_3K$ | $-CH_2CH_2CN$ | 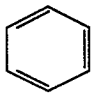 | | H | H | H | H | H |
| -31 | $-(CH_2)_4SO_3Na$ | $-CH_2CH_2SO_2CH_3$ | H | H | H | H | H | H | Cl |
| -32 | $-(CH_2)_4SO_3Na$ | $-CH_2CH_2NHSO_2CH_3$ | H | Cl | H | H | $-CH_3$ | H | H |
| -33 | $-(CH_2)_3SO_3K$ | $-CH_2CH_2CN$ | H | $-OCH_3$ | H | H | H | H | $-OCH_3$ |
| -34 | $HO-CH(CH_2SO_3K)-CH_2$ | $-CH_2CH_2NHSO_2CH_3$ | H | Cl | $-CH_3$ | H | H | H | H |

[II]-35

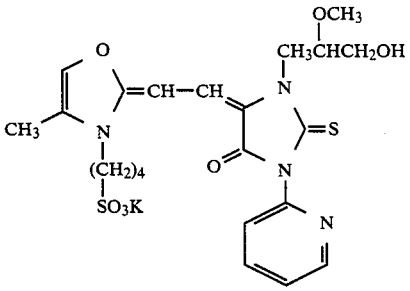

[II]-36

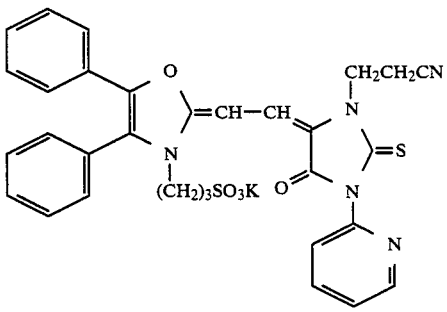

-continued

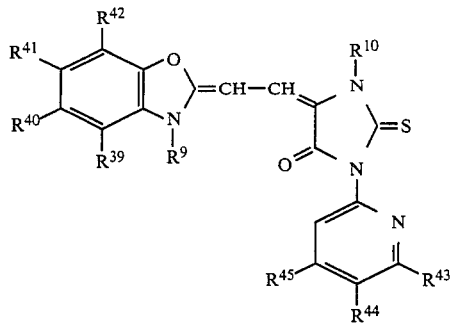

| substituent | $R^9$ | $R^{10}$ | $R^{39}$ | $R^{40}$ | $R^{41}$ | $R^{42}$ | $R^{43}$ | $R^{44}$ | $R^{45}$ |
|---|---|---|---|---|---|---|---|---|---|
| [II]-1 | $-(CH_2)_2SO_3K$ | $-CH_2CO_2CH_2CH_2CH_2OH$ | H | H | H | H | H | H | H |
| -2 | $-(CH_2)_4SO_3K$ | $-CH(F)CH(F)OH$ | H | H | H | H | H | H | H |
| -3 | $-(CH_2)_2SO_3NH_2$ | $-CH_2CH(OCH_3)CH_2OCH_3$ | H | H | H | H | H | H | H |
| -4 | $-(CH_2)_4SO_3K$ | $-CH_2CH_2OCH_2CH_2OH$ | H | H | H | H | H | H | H |
| -5 | $-(CH_2)_3SO_3K$ | $-CH_2CH_2OCH_2CH_2OH$ | H | Cl | H | H | H | H | H |
| -6 | $-(CH_2)_3SO_3K$ | $-CH_2CH_2OCH_2CH_2OH$ | H | $CH_3CO-$ (O) | H | H | H | H | H |
| -7 | $-(CH_2)_4SO_3K$ | $-CH_2CH(OCH_3)CH_3$ | H | H | H | H | H | H | H |
| -8 | $-(CH_2)_4SO_3K$ | 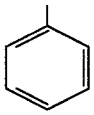 | H | H | H | H | H | H | H |
| -9 | $-(CH_2)_3SO_3K$ | 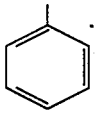 | H | H | H | H | H | $-SO_3K$ | H |
| -10 | $-(CH_2)_4SO_3K$ | $-CH_2CONHCH_2CH_2OH$ | H | H | H | H | H | H | H |
| -11 | $-(CH_2)_3SO_3K$ | $-CH_2CON(CH_2)(CH(F)CH_2OH)$ | H | $-CH_3$ | H | H | H | H | H |

-continued
| | | | | | | | | |
|---|---|---|---|---|---|---|---|---|
| -12 | $(CH_2)_3SO_3K$ | $-CH_2CON(CH(F)CH_2OH)_2$ | H | $-OH$ | H | H | H | H | H |
| -13 | $CH_2$<br>$CH-OH$<br>$CH_2SO_3K$ | $-CH_2CONHCH_2CH_2OH$ | H | $-OCH_3$ | H | H | H | H | H |
| -14 | $(CH_2)_4SO_3K$ | $-CH_2CH_2OCH_2CH_2CN$ | | 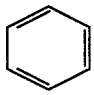 | H | H | H | $-(CH_2)_4SO_3K$ | H |
| -15 | $(CH_2)_4SO_3K$ | $-CH_2CH_2OCH(F)CH_2OH$ | H | 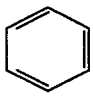 | | H | H | H | H |
| -16 | $(CH_2)_4SO_3K$ | $-CF_2CH_2CONH_2$ | H | H | H | H | $-CH_3$ | H | H |
| -17 | $(CH_2)_4SO_3K$ | $-CH_2CH(OCH_3)CH_2OCH_3$ | H | H | H | H | H | $-CH_3$ | H |
II-37
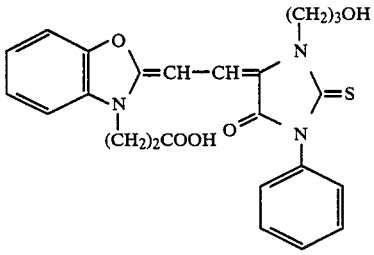
II-38
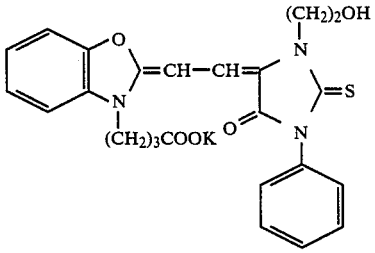
II-39
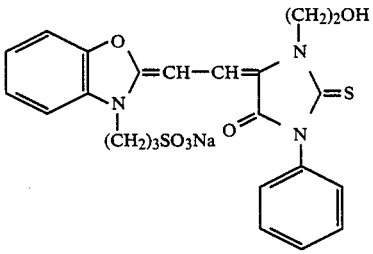

-continued

II-40

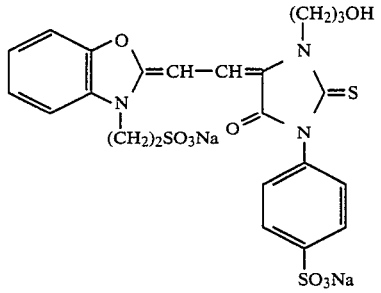

II-41

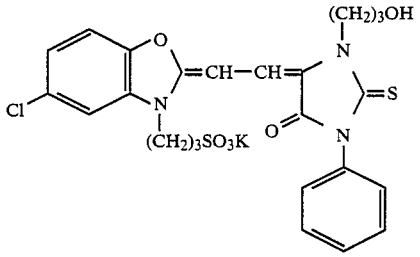

II-42

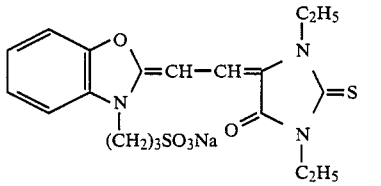

II-43

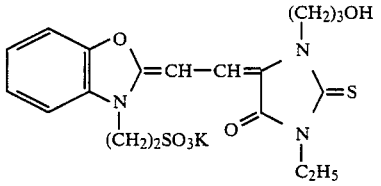

II-44

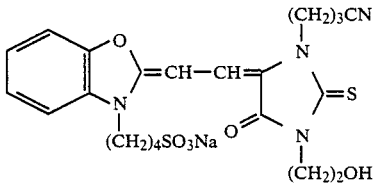

II-45

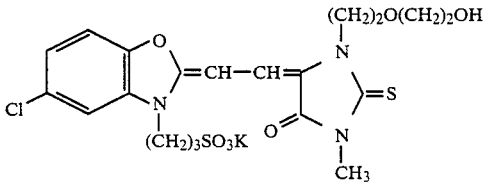

The sensitizing dyes which are to be used in the invention may be added and dispersed into a silver halide emulsion in a variety of methods having been known so far. For example, the method of adding and dispersing these dyes together with a surface active agent, as described in Japanese Patent Examined Publication No. 44895-1974 and Japanese Patent O.P.I. Publication No. 11419-1975; the method of adding them in the form of the dispersion thereof with a hydrophilic substrate, as described in Japanese Patent O.P.I. Publication Nos. 16624-1978, 102732-1978 and 102733-1978, U.S. Pat. Nos. 3,469,987 and 3,676,147; the method of adding them in the form of a solid solution, as described in East German Pat. No. 143,324; and so forth. Besides the above methods, it is also allowed to add a sensitizing dye into an emulsion after dissolving the dye in an independent water-soluble solvent or the mixed solvent of water, ethanol, methanol, cetone, n-propanol, fluorinated alcohol, pyridine and so forth. The sensitizing dyes may be added at any point of time in the course of preparing an emulsion, however, it should be preferably to add them at the point of time either during or after a chemical ripening is carried out.

In the invention, it is allowed to use two or more kinds of the sensitizing dyes in combination and, besides, a sensitizing dye capable of providing the other color-sensitivity such as a monomethine-cyanine dye or the like may also be used in combination. When using the other sensitizing dye in combination, the sensitizing dye used in the invention and the other sensitizing dye may be added to separate times. For example, it is allowed to add the other sensitizing dye, which is to be used in combination, at a point of time from the time after an emulsion is chemically ripened to the time before the emulsion is to be coated on, while a trimethine dye, which is used in the invention, in the course of chemically ripening the emulsion, respectively.

The amount of the dyes used in the invention to be added is to be an amount enough to spectrally sensitizing a silver halide emulsion, for example, an amount of from $5\times10^{-6}$ to $2\times10^{-2}$ mol per mol of the silver halide used and, more preferably, from $5\times10^{-5}$ to $2\times10^{-3}$ mol.

An emulsion is allowed to contain, together with the sensitizing dyes, a substance capable of displaying a super color sensitization without substantially absorbing any visible rays of light including, for example, a compound having a pyrimidylamino or triazinylamino group described in U.S. Pat. Nos. 2,933,390, 3,511,664, 3,615,613, 3,615,632, 3,615,641 and so forth; an aromatic organic acid-formaldehyde condensation an azaindene; a cadmium salt; and so forth described in British Pat. No. 1,137,580.

As for the dyes applicable to the invention, those of oxonol, hemioxonol, merocyanine, cyanine, azo or the like may be used. Among them a water-soluble dyes are advantageously used from the viewpoint of eliminating residual colors still remaining after processing.

For further details, the following dyes may be used, for example, a pyrazolone oxonol dye described in U.S. Pat. No. 2,274,782; a diarylazo dye described in U.S. Pat. No. 2,956,879; a styryl or butadienyl dye described in U.S. Pat. Nos. 3,423,207 and 3,384,487; a merocyanine dye described in U.S. Pat. No. 2,527,583; a merocyanine or oxonol dye described in U.S. Pat. Nos. 3,486,897, 3,652,284 and 3,718,472; an enaminohemioxonol dye described in U.S. Pat. No. 3,976,661; and the dyes described in British Pat. Nos. 584,609 and 1,177,429, Japanese Patent O.P.I. Publication Nos. 85130-1973, 99620-1974 and 114420-1974, and U.S. Pat. Nos. 2,533,472, 3,148,187, 3,177,078, 3,247,127, 3,540,887, 3,575,704 and 3,653,905.

In the invention, a water-soluble dye having an absorption maximum of not less than 700 nm is to be used. The typical examples of these dyes include those represented by the following formulas III-a and III-b.

Formula III-a

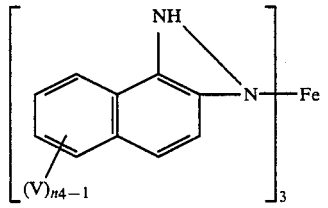

Formula III-b

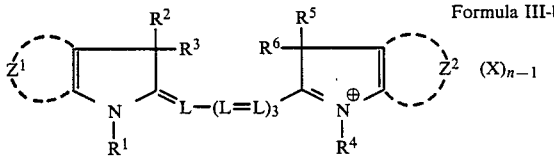

wherein V represents a group of sulfo or carboxy; $R^{51}$, $R^{52}$, $R^{53}$, $R^{54}$, $R^{55}$ and $R^{56}$ may be the same with or the different from each other and each represent a substituted or non-substituted alkyl group; $Z^1$ and $Z^2$ represent a group of non-metal atoms necessary to complete a substituted or non-substituted benzo or naphtho condensed ring, provided that the groups represented by $R^{51}$, $R^{52}$, $R^{53}$, $R^{54}$, $R^{55}$, $R^{56}$, $Z^1$ and $Z^2$ contain at least three acid groups in total; L represents a substituted or non-substituted methine group; and X represents an anion;

$n_1$ is an integer of 2, 3 or 4.

The typical examples of the dyes which may be used in the invention will be given below.

[III-1]

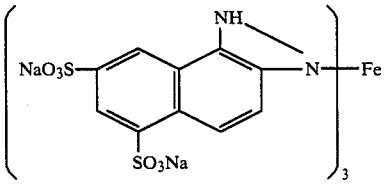

[III-2]

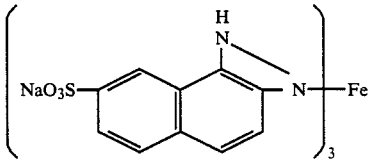

[III-3]

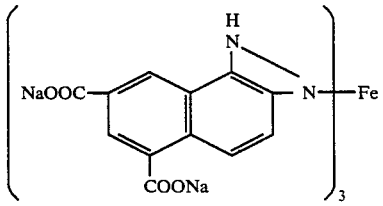

-continued
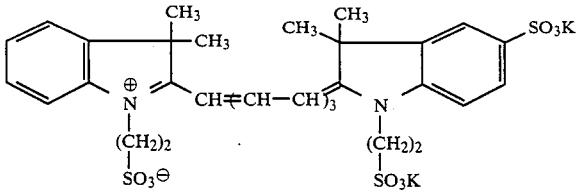
[III-4]
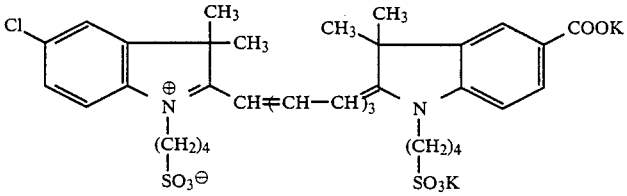
[III-5]
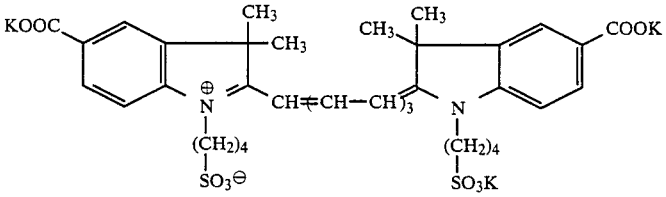
[III-6]
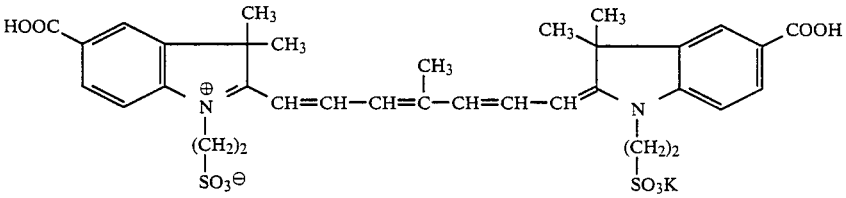
[III-7]
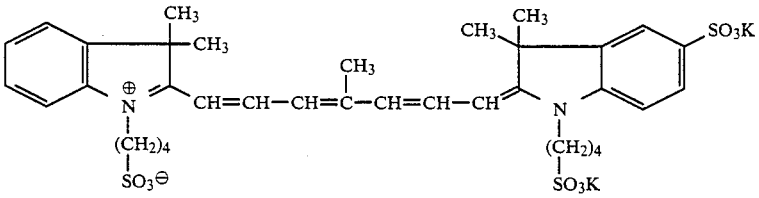
[III-8]
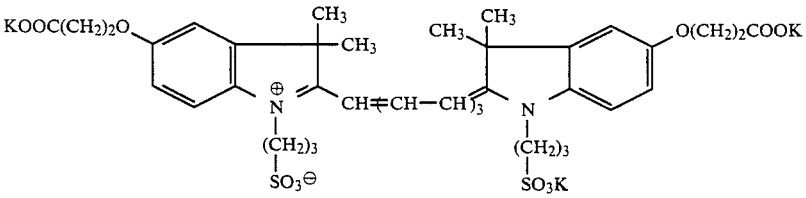
[III-9]
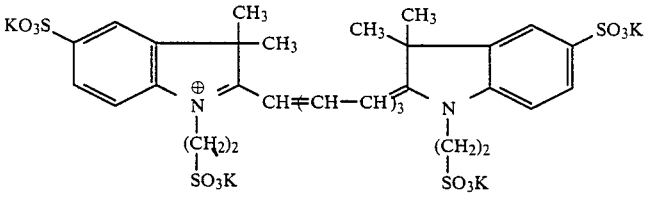
[III-10]
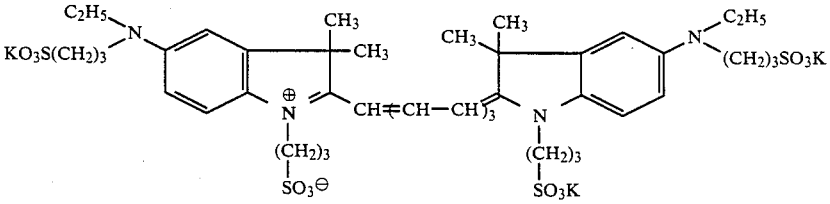
[III-11]

-continued
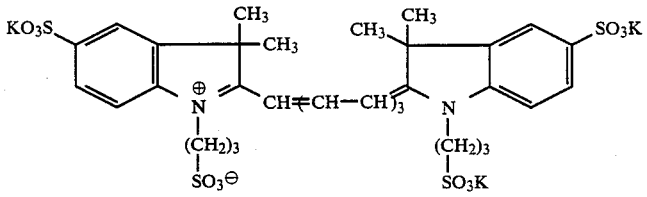
[III-12]
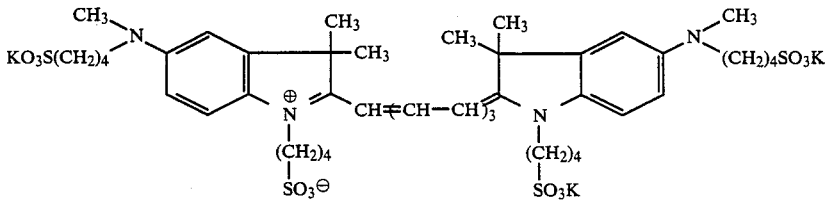
[III-13]
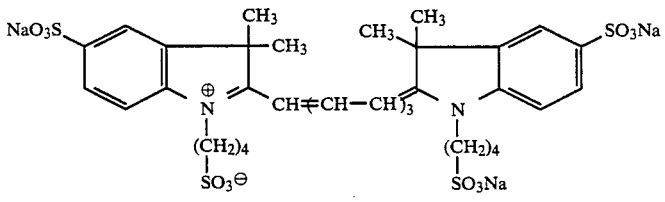
[III-14]
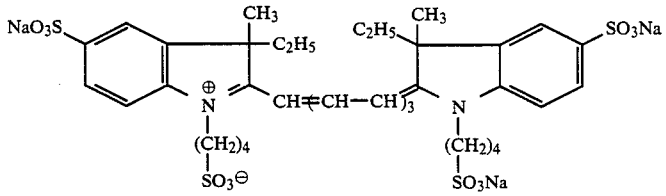
[III-15]
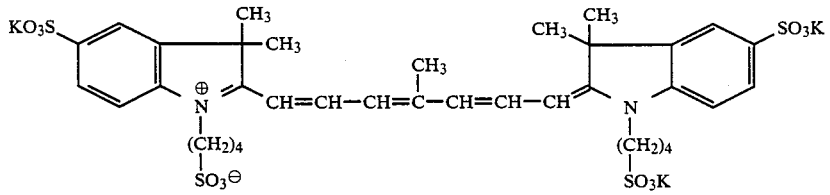
[III-16]
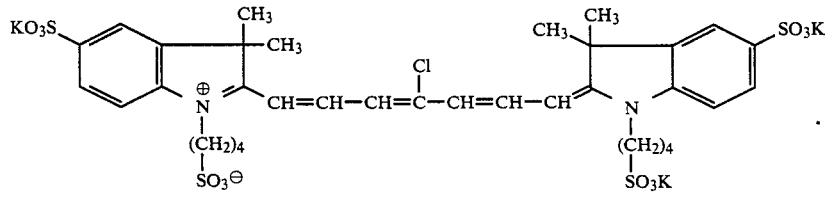
[III-17]
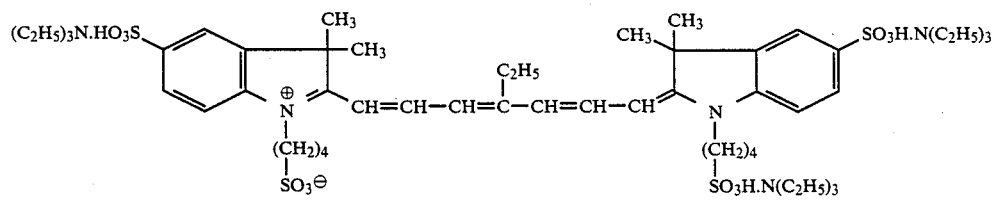
[III-18]

-continued
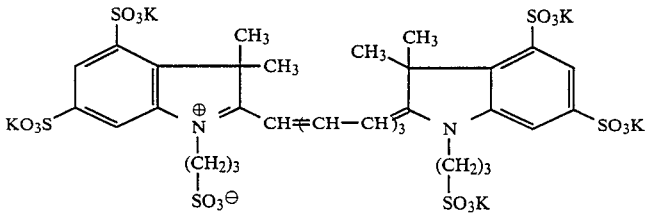
[III-19]
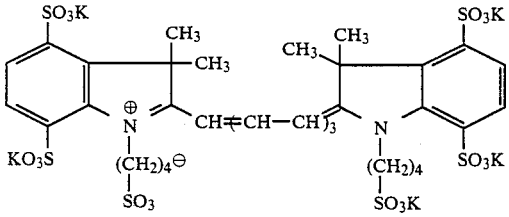
[III-20]
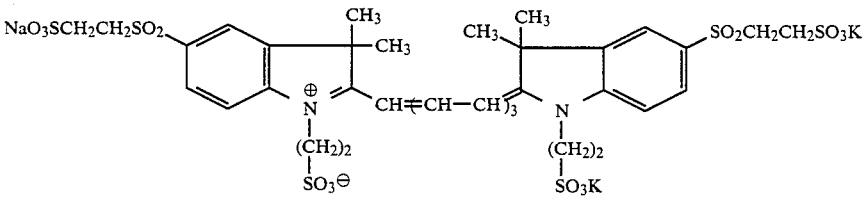
[III-21]
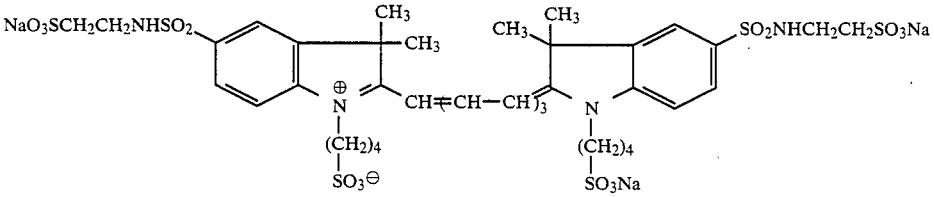
[III-22]
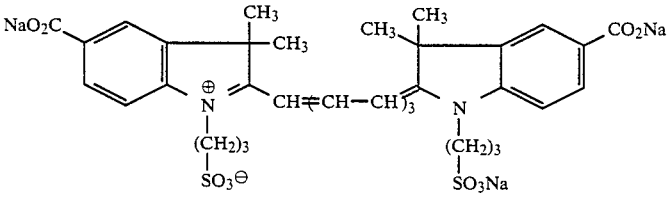
[III-23]
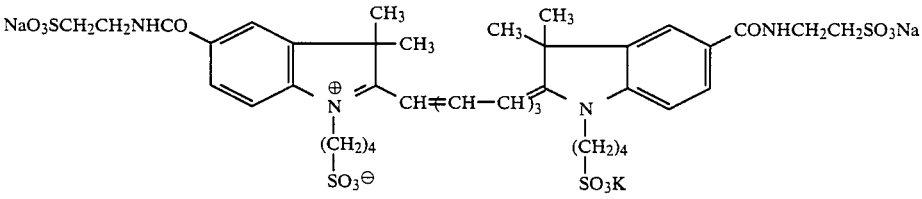
[III-24]
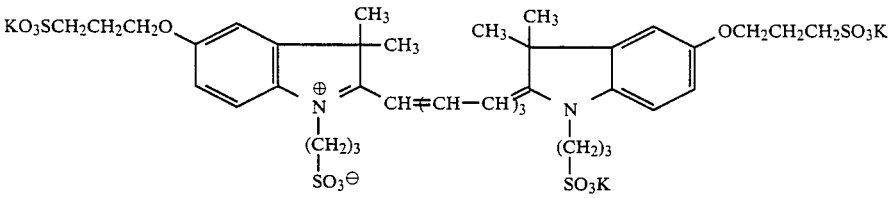
[III-25]
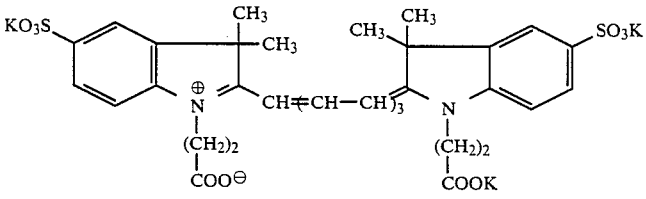
[III-26]

-continued
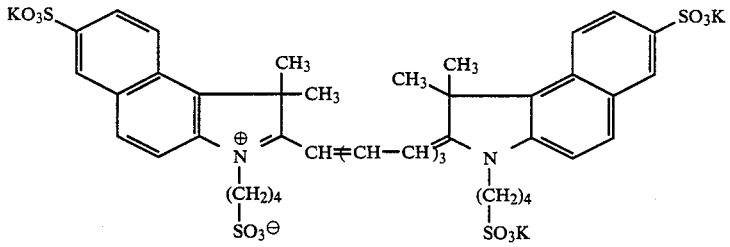
[III-27]
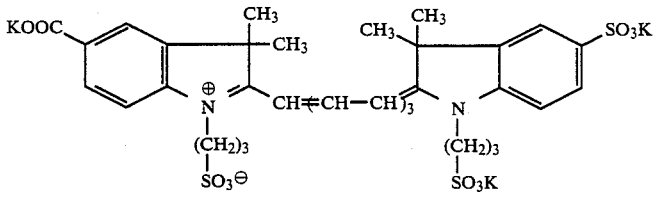
[III-28]
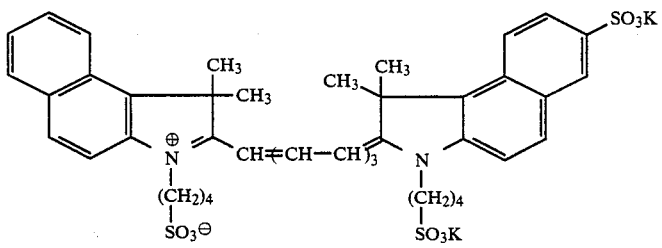
[III-29]
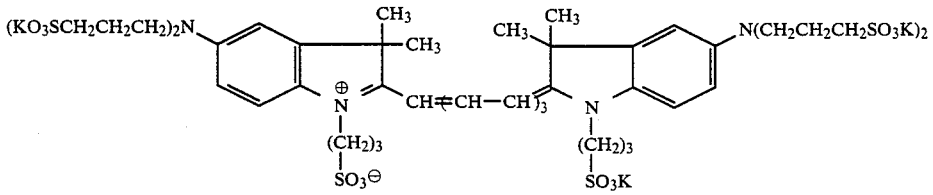
[III-30]
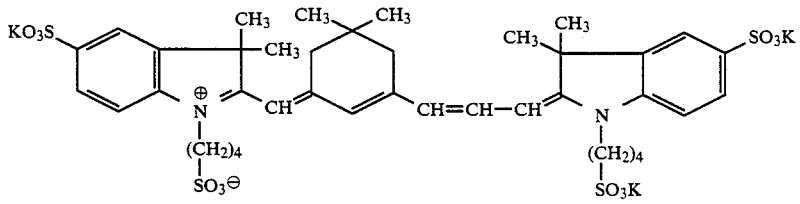
[III-31]
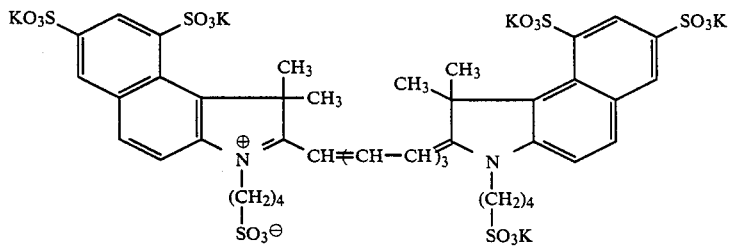
[III-32]

-continued

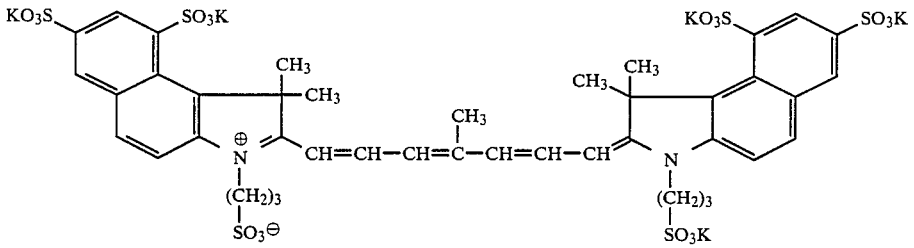

[III-33]

The dyes represented by Formulas III-a through III-e may be added into the hydrophilic colloidal layers of the invention after dissolving the dyes in a suitable solvent including water, alcohol such as methanol, ethanol, propanol, etc., acetone and so forth or in the mixed solvent thereof.

It is allowed to use two or more kinds of these dyes in combination.

The amount of the dyes used varies according to the purposes of using them, however, it is within the range of usually from $10^{-3}$ g/m$^2$ to 1 g/m$^2$ and, more preferably, from $10^{-3}$ g/m$^2$ to 0.5 g/m$^2$.

These dyes is added into a non-light-sensitive hydrophilic colloidal layer arranged to the upper side of the emulsion layer. It is preferred to add these dyes into an emulsion layer together with the non-light-sensitive hydrophlic colloidal layer such as a protective layer.

The layers which are tinted in accordance with the invention are allowed to contain a high molecular mordant as well as a hydrophilic colloid. Such mordants include, for example, a polymer derived from an ethylene type unsaturated compound having a dialkylaminoalkyl ester residual group such as those described in British Pat. No. 685,475; the copolymers of the above-given polymers such as those described in U.S. Pat. No. 2,839,401; the maleic anhydride copolymers of the derivatives thereof such as those described in British Pat. No. 906,083; a polymer prepared upon reaction of polyvinylalkylketone with aminoguanidine, such as those described in British Pat. No. 850,281; a polymer having a 2-methylimidazole nucleus in the side chain thereof, such as those described in U.S. Pat. No. 3,445,231; the addition polymers of bisacrylamide with secondary diamine or the quaternary salts thereof, such as those described in Japanese Patent O.P.I. Publication No. 24733-1973; a ternary or quaternary polymer containing polyvinyl pyridine or polyvinyl quinoline, such as those described in British Pat. Nos. 765,520 and 766,202; a polymer such as those described in West German Pat. Nos. 1,914,361 and 1,914,362; and, besides the above, it is allowed to use a variety of polymers which are well known as the mordants applicable to the acidic dyes suitably used in light-sensitive materials.

In the silver halide emulsions of the invention, it is allowed to use any of silver halides which may be used in the ordinary silver halide emulsions, such as silver bromide, silver iodobromide, silver iodochloride, silver chlorobromide, silver chloroiodobromide, silver chloride and so forth. It is, however, desired that these emulsion should be a monodisperse type emulsion. The term, a 'monodisperse type emulsion', stated herein means an emulsion having a grain size distribution in which the grain sizes of 90% by quantity of the toal silver halide grains are to be within plus or minus 40% of the avergae grain size of the total grains.

It is also allowed to mix two or more kinds of emulsions together so as to obtain a desired gradation.

The matte films relating to the invention may be prepared by adding a matting agent into the hydrophilic colloidal layers thereof.

For the matting agents, the fine grains of well known water-insoluble organic or inorganic compounds may be used.

The examples of the organic compounds which may preferably be used in the invention include water-dispersible vinyl polymers such as polymethyl methacrylate, polyacrylonitrile, an acrylonitrile-α-methylstyrene copolymer, polystyrene, stryene-vinylbenzene copolymer, polyvinyl acetate, polyethylene carbonate, polytetrafluoroethylene and so forth, cellulose derivatives such as methyl cellulose, ethyl cellulose, cellulose acetate, cellulose acetatepropionate and so forth, starch derivatives such as carboxy starch, carboxynitrophenylstarch, a urea- formaldehyde-starch reacted product and so forth, gelatin hardened with a well known hardening agent, gelatin hardened by a coacervation to make the grain to be in the microcapsuled hollow form, and so forth.

The examples of the inorganic compounds which may preferably be used include silicon dioxide, titanium dioxide, magnesium dioxide, aluminium dioxide, barium sulfate, calcium carbonate, silver chloride and silver bromide each desensitized in a well known method, glass, diatom earth and so forth. If occasion demands, the above-mentioned matting agents may also be used together with different kinds of substances in the form of the mixture.

The matting agents which are to be used in the invention may also be added into any of the hydrophilic colloidal layers included the photographic component layer such as, typically, a silver halide emulsion layer, a surface protective layer, an interlayer, a subbing layer, and so forth. The kinds, shapes, sizes and the amounts of the matting agents to be added may freely be selected. It is, however, desired to adjust the center-line average roughness (Ra) of a light-sensitive material surface on the side where a hydrophilic colloidal layer containing a matting agent is to be within the range of from 0.15 to 0.8 μm. If Ra is less than 0.15 μm, the retouchability is deteriorated and, if it exceeds 0.8 μm, the writing smoothness is deteriorated. It is, therefore, more preferable that Ra should be within the range of from 0.3 to 0.6 μm.

The center-line average roughness stated herein is to be obtained in accordance with the method specified in Japanese Industrial Standard, JIS B-0601.

It is, further, allowed to use a variety of additives in the light-sensitive materials of the invention according to the purposes of applications.

Further details of these additives may be referred to the descriptions in Research Disclosure, Vol 176, Item 17643, Dec., 1978 and Vol. 187, Item 18716, Nov., 1979. The data relevant thereto are collectively given in the table shown below.

There is not any special limitation to the exposure and processing conditions of the light-sensitive materials of the invention, but the conditions may be referred to the description in the above-given Research Disclosure, Vol. 176, pp. 28–30.

| Additive | RD17643 | RD18716 |
|---|---|---|
| 1. Chemical sensitizer | p. 23 | R. Col. on p. 648 |
| 2. Sensitivity increasing agent | | The same as above |
| 3. Hardener | p. 26 | L. Col. on p. 651 |
| 4. Whitening agent | p. 24 | |
| 5. Antifoggant/Stabilizer | pp. 24–25 | R. Col. on p. 649 |
| 6. Light absorbent, Filter-dye, UV-absorbent | pp. 25–26 | R. Col. on p. 649 to L. col. on p. 650 |
| 7. Antistaining agent | R. Col. on p. 25 | L. Col. to R. Col. on p. 650 |
| 8. Dye-image stabilizer | p. 25 | |
| 9. Plasticizer/Lubricant | p. 27 | R. Col. on p. 650 |
| 10. Antistatic agent | p. 27 | The same as above |
| 11. Coating aid/Surfactant | pp. 26–27 | The same as above |
| 12. Binder | p. 26 | L. Col. on p. 651 |

The supports which are to be used in the light-sensitive materials of the invention should preferably be transparent, because such a light-sensitive material of the invention is mostly used as an original document for diazo-type print copying after it was processed. The materials of the above-mentioned supports include, for example, cellulose acetate, cellulose nitrate, polystyrene, polyvinyl chloride, polyethyleneterephthalate, polycarbonate, polyamide and so forth.

The light-sensitive materials of the invention may be processed in any known methods. According to the purposes, they may be processed in either methods, one i.e., a black-and-white processing, for producing silver images and the other for producing color images.

In the black-and-white processing, a developing step, a fixing step and a washing step are carried out. When the developing step and then a stopping step are carried out, or when the fixing step and then a stabilizing step are carried out, there may be some instances where the washing step may be omitted. It is also allowed to carry out the developing step by making use of only an alkaline solution, provided that a light-sensitive material is incorporated thereinto with a developing agent or the precursor thereof. It is further allowed to apply a developing step in which a lith developer is used as the developer.

EXAMPLE 1

Silver halide-based emulsions A and B were prepared in the following processes so as to use them in this example.

Emulsion A

In the presence of rhodium chloride in an amount of $4\times10^{-8}$ mols and iridium chloride in an amount of $8\times10^{-7}$ mols each per mol of silver, an aqueous solution of silver nitrate and an aqueous solution of both sodium chloride and potassium bromide were added at the same time taking for 70 minutes into a gelatin solution which was kept at 40° C. and, all the while, pAg and pH of the solution were kept at 7.7 and 3.0, respectively, so that a cubic monodispersed emulsion having an average grain size of 0.25 μm and a silver bromide content of 35 mol % was prepared. The resulted emulsion was added with sodium thiosulfate in an amount of 12 mg and chloroauric acid in an amount of 15 mg each per mol of silver and was then chemically sensitized at 60° C. for 70 minuted. After then, 4-hydroxy-6-methyl-1,3,3a,7-tetrazaindene was added as a stabilizer.

Emulsion B

In the presence of iridium chloride in an amount of $4\times10^{-7}$ mols per mol of silver and ammonia, an aqueous solution of silver nitrate and an aqueous solution of both potassium iodide and potassium bromide were added at the same time taking for 60 minutes into a gelatin solution which was kept at 50° C. and, all the while, pAg of the solution was kept at 7.5, so that a cubic monodisperse emulsion having an average grain size of 0.25 μm and a silver iodide content of 1 mol % was prepared. The resulted emulsion was added with sodium thiosulfate in an amount of 7.5 mg per mol of silver and was then chemically sensitized at 62° C. for 60 minuted.

The resulted Emulsion A was added with the sensitizing dye indicated in Table-1 and was then spectrally sensitized. Further, ethyl acrylate-methacrylic acid copolymer latex, saponin, 1-phenyl-5-mercaptotetrazole, hydroquinone and styrene-maleic acid copolymer were added. The resulted coating material was coated on a polyethyleneterephthalate film so as to be in terms of a silver amount of 3.0 g/m$^2$. Onto the resulted emulsion layer, at the same time, a gelatin layer containing the dye indicated in Table-1 and formalin was coated so as to be in an amount of the gelatin coated of 1.5 g/m$^2$.

Evaluation of relative sensitivity and safelight sensitivity.

The resulted sample was exposed to light by making use of a photosensitometer having a tungsten light source. After the exposure, the sample was processed with an automatic processor, GR-26 manufactured by Konishiroku Photo Ind. Co., Ltd., loaded with the developer and fixer each having the following compositions, so that a sample for evaluation use was obtained.

As for the processing conditions, the development was made for 20 seconds at 40° C., the fixation was for 20 seconds at 35° C. and the washing was for 20 seconds at an ordinary temperature, respectively.

The density of the processed sample was measured by making use of a densitometer to obtain a sensitivity and fogginess. The sensitivity is expressed in terms of the reciprocal numerals of an exposure capable of giving a density of 1.0, and the sensitivity of each sample is expressed in terms of the values relative to that of Sample No. 1 which is regarded as a value of 100. Each of the fogginess is expressed by a density of the unexposed area of the processed samples.

The density variations occurred after applying a safe light were measure in such a manner that, after the samples were exposed to light by making use of the above-mentioned photosensitometer so as to give a density of 1.0, the samples were applied by a 15 W tungsten lamp from a distance of 1.0 meter for 30 minutes through a safe light filter, No. 1A manufactured by Eastman Kodak Co., and were then processed in the above-mentioned processing method, and the resulted densities thereof were measured.

The results thereof are shown in Table-1.

<Composition of Developer>

| | |
|---|---|
| Pure water (Ion-exchanged water) | About 800 ml |
| Potassium sulfite | 60 g |
| Disodium ethylenediaminetetraacetate | 2 g |
| Potassium hydroxide | 10.5 g |
| 5-methylbenzotriazole | 300 mg |
| Diethylene glycol | 25 g |
| 1-phenyl-4,4-dimethyl-3-pyrazolidinone | 300 mg |
| 1-phenyl-5-mercaptotetrazole | 600 mg |
| Potassium bromide | 3.5 g |
| Hydroquinone | 20 g |
| Potassium carbonate | 15 g |
| Add pure water (ion-exchanged water) to make | 1000 ml. |
| pH of the developer was approximately pH 10.8. | |

<Composition of Fixer>

| | |
|---|---|
| Ammonium thiosulfate (in an aqueous 72.5% W/V solution) | 240 ml |
| Sodium sulfite | 17 g |
| Sodium acetate, trihydrate | 6.5 g |
| Boric acid | 6 g |
| Sodium citrate, dihydrate | 2 g |
| Acetic acid (in an aqueous 90% M/V solution) | 25 ml |

When using this fixer, the above-mentioned composition was dissolved in 500 ml of water to make one liter.

The pH of this fixer was approximately 4.5.

As is obvious from Table-1, with each of the samples not added with the dyes of the invention, the density variations become serious after a safe light was applied and the safe light sensitivity becomes poor and, further, the sensitivity becomes low if the sensitizing dye content of a sample is so reduced as to restrain the density variations which may occur after the safe light is applied.

On the other hand, with Samples No. 6 through No. 14 relating to the invention, which were added with the dyes of the invention into the protective layer thereof, the sensitivity was lowered next to nothing and the density variations were restrained after the safe light was applied.

EXAMPLE 2

The resulted Emulsion B was added with the sensitizing dye indicated in Table-2 and, further, 4-hydroxy-6-methyl-1,3,3a,7-tetrazaindene, polyethyl acrylate latex, polyethylene glycol, 1-phenyl-5-mercaptotetrazole and 2-hydroxy-4,6-dichloro-1,3,5-triazine sodium salt were added as a stabilizer. The resulted coating material was coated on a polyethyleneterephthalate film in an amount of 4.0 g/m$^2$ in terms of silver used. Onto the resulted emulsion layer, at the same time, a gelatin layer containing the dye indicated in Table-2 was coated in the gelatin coating amount of 1.0 g/m$^2$.

Each of the samples was exposed to light and processed and, further, evaluated, in the same manner as in Example 1.

TABLE 1

| Sample No. | Sensitizing dye Kind | Sensitizing dye Amount added (mg/mol Ag) | Dye in protective layer Kind | Dye in protective layer Amount added (mg/m$^2$) | Reelative sensitivity | Fog | Density variation after safelight application | |
|---|---|---|---|---|---|---|---|---|
| 1 | II-39 | 200 | — | — | 100 | 0.05 | 0.35 | Comp. Sample |
| 2 | " | 150 | — | — | 80 | 0.04 | 0.25 | Comp. Sample |
| 3 | " | 100 | — | — | 42 | 0.04 | 0.15 | Comp. Sample |
| 4 | I-1 | 200 | — | — | 90 | 0.06 | 0.42 | Comp. Sample |
| 5 | II-23 | 200 | — | — | 100 | 0.05 | 0.35 | Comp. Sample |
| 6 | I-1 | 200 | III-1 | 40 | 88 | 0.05 | 0.10 | Sample of the Invention |
| 7 | " | " | III-14 | 30 | 88 | 0.05 | 0.10 | Sample of the Invention |
| 8 | " | " | III-26 | 30 | 88 | 0.05 | 0.12 | Sample of the Invention |
| 9 | II-23 | 200 | III-1 | 40 | 98 | 0.04 | 0.08 | Sample of the Invention |
| 10 | " | " | III-14 | 30 | 98 | 0.04 | 0.08 | Sample of the Invention |
| 11 | " | " | III-26 | 30 | 98 | 0.04 | 0.08 | Sample of the Invention |
| 12 | II-39 | 200 | III-1 | 40 | 98 | 0.04 | 0.08 | Sample of the Invention |
| 13 | " | " | III-14 | 30 | 98 | 0.04 | 0.08 | Sample of the Invention |
| 14 | " | " | III-26 | 30 | 98 | 0.04 | 0.10 | Sample of the Invention |

The results thereof are shown in Table-2 below.

TABLE 2

| Sample No. | Sensitizing dye Kind | Sensitizing dye Amount added (mg/mol Ag) | Dye in protective layer Kind | Dye in protective layer Amount added (mg/m$^2$) | Reelative sensitivity | Fog | Density variation after safelight application | |
|---|---|---|---|---|---|---|---|---|
| 21 | I-1 | 200 | — | — | 100 | 0.05 | 0.32 | Comp. Sample |
| 22 | " | 150 | — | — | 75 | 0.04 | 0.23 | Comp. Sample |
| 23 | " | 100 | — | — | 40 | 0.04 | 0.17 | Comp. Sample |
| 24 | I-12 | 200 | — | — | 100 | 0.05 | 0.33 | Comp. Sample |
| 25 | II-5 | 200 | — | — | 100 | 0.04 | 0.30 | Comp. Sample |

TABLE 2-continued

| Sample No. | Sensitizing dye Kind | Sensitizing dye Amount added (mg/mol Ag) | Dye in protective layer Kind | Dye in protective layer Amount added (mg/m²) | Reelative sensitivity | Fog | Density variation after safelight application | |
|---|---|---|---|---|---|---|---|---|
| 26 | II-45 | 200 | — | — | 100 | 0.05 | 0.30 | Comp. Sample |
| 27 | I-1 | 200 | III-1 | 40 | 98 | 0.04 | 0.10 | Sample of the Invention |
| 28 | " | " | III-13 | 30 | 98 | 0.04 | 0.10 | Sample of the Invention |
| 29 | I-12 | 200 | III-1 | 40 | 98 | 0.04 | 0.11 | Sample of the Invention |
| 30 | " | " | III-13 | 30 | 98 | 0.04 | 0.11 | Sample of the Invention |
| 31 | II-5 | 200 | III-1 | 40 | 98 | 0.04 | 0.09 | Sample of the Invention |
| 32 | " | " | III-13 | 30 | 98 | 0.04 | 0.09 | Sample of the Invention |
| 33 | II-45 | 200 | III-1 | 40 | 98 | 0.04 | 0.09 | Sample of the Invention |
| 34 | " | " | III-13 | 30 | 98 | 0.04 | 0.09 | Sample of the Invention |

As is obvious from Table-2, with the samples not containing any dye of the invention, the density variations are serious after a safe light was applied and the safe light sensitivity is deteriorated and, further the sensitivity is lowered if the sensitizing dye content is so reduced as to restrain the density variations which may occur after the safe light was applied.

On the other hand, with each of Samples No. 27 through No. 34 which was added with the dye of the invention into the protective layer thereof, the sensitivity was lowered next to nothing and the density variations were restrained after the safe light was applied.

EXAMPLE 3

Preparation of Coating Liquids for Silver Halide Emulsion Layers

First, the following solutions, (A), (B), (C) and (D), were prepared.

| | | |
|---|---|---|
| (A) | Water | 980 ml |
| | Gelatin | 10 g |
| | Sodium chloride | 2 g |
| (B) | Water | 380 ml |
| | Gelatin | 10 g |
| | Sodium chloride | 30 g |
| | Potassium bromide | 60 g |
| (C) | Water | 380 ml |
| | Silver nitrate | 170 g |
| (D) | Water | 100 ml |
| | Potassium bromide | 35 g |

Into Solution (A) which was being kept at 45° C. and stirred, Solutions (B) and (C) were functionally added at the same time while keeping at pH 6.0 and pAg 7.5 and taking 41 minutes. Two minutes after the completion of the addition, Solution (D) was added by taking 4 minutes. The temperature of the resulted solution was lowered to 40° C. and was then desalted and washed in ordinary methods. Last, 15 g of gelatin was added, so that Emulsion-I having an average grain size of 0.25 μm was obtained.

Next, the following solutions, (E), (F), (G), (H), (I) and (J), were prepared, respectively.

| | | |
|---|---|---|
| (E) | Water | 980 ml |
| | Gelatin | 10 g |

-continued

| | | |
|---|---|---|
| | Sodium chloride | 2 g |
| (F) | Water | 120 ml |
| | Gelatin | 2.5 g |
| | Sodium chloride | 0.85 g |
| | Potassium bromide | 1.7 g |
| (G) | Water | 370 ml |
| | Gelatin | 8.8 g |
| | Sodium chloride | 28 g |
| | Potassium bromide | 58 g |
| (H) | Water | 120 ml |
| | Silver nitrate | 4.8 g |
| (J) | Water | 100 ml |
| | Potassium bromide | 35 g |

Into Solution (E) which was being kept at 45° C. and stirred, Solutions (F) and (H) were functionally added while keeping at pH 6.0 and pAg 7.5 and taking 10 minutes and, succesively, Solutions (G) and (I) were functionally added by taking 70 minutes. Two minutes after the completion of the addition, Solution (J) was added by taking 4 minutes. The temperature of the resulted solution was lowered to 40° C. and was then desalted and washed in ordinary methods. Last, 15 g of gelatin was added, so that Emulsion-II having an average grain size of 0.40 μm was obtained.

Next, into Emulsion-I, 0.1 g of 4-hydroxy-6-methyl-1,3,3a,7-tetrazaindene and 6 mg of sodium thiosulfate were added. The resulted matter was ripened at 50° C. for 60 minutes and was then sulfur-sensitized. After then, 70 mg of 1-phenyl-5-mercaptotetrazole, 1 g of 4-hydroxy-6-methyl-1,3,3a,7-tetraazaindene and 40 g of gelatin were added.

Meanwhile, into Emulsion-II, 1.5 mg of sodium thiosulfate were added. The resulted matter was ripened at 50° C. for 80 minutes and was then sulfur-sensitized. Thereafter, 70 mg of 1-phenyl-5-mercaptotetrazole, 1 g of 4-hydroxy-6-methyl-1,3,3a,7-tetrazaindene and 40 g of gelatin were added.

Further, Emulsions-I and II were mixed up and, thereto, the green spectrally sensitizing dye indicate in Table-3 in the amount indicated in Table-3 and 60 mg of the following blue spectrally sensitizing dye (b) were added. The resulted matter was spetrally sensitized and was further added with 3.7 g of saponin as a coating aid, 2 g of hydroquinone as a stabilizer, rice-starch having an average particle size of 2.6 μm as a matting agent in the amount shown in Table-3, 30 g of polybutyl acrylate as a latex polymer, 1 g of styrene-maleic anhydride as a thickening agent and 0.8 g of sodium 2,4-dichloro-6-hydroxy-s-triazine. Last, the pH of the resulted matter was adjusted with citric acid to be 5.5, so that a coating liquid for emulsion layers was prepared.

(b)

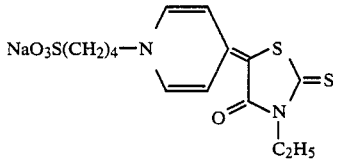

Preparation of Coating Liquid for Protective Layer

Gelatin of 100 g were added with 1400 ml of water, and dissolved. The resulted solution was added with silica having an average particle size of 3.5 μm as a matting agent in the amount shown in Table-3, 2 g of saponin as a surfactant and the following compound (c), and then with the compound shown in Table-3 as a dye and 3 g of formalin as a hardener, so that a coating liquid for protective layers was prepaed. And, the pH of this coating liquid was 6.0.

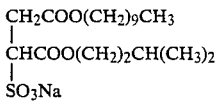

(c)

The average particle sizes of the rice-starch and silica were measured with a laser micron-sizer manufactured by Seishin Enterprise Co.

Preparation of Coating Liquid for Lower Backing Layer

Gelatin of 100 g were added with 1600 ml of water, and dissolved. The resulted solution was added with 5 g of the following compound (e), 1 g of (f) and 1.5 g of (g) as dyes, respectively, 40 g of rice-starch having an average particle size of 2.6 μm as a matting agent, 5 g of saponin as a surfactant, 1 g of styrene-maleic anhydride as a thickening agent and 1 g of glyoxal as a hardener. Last, the pH of the resulted matter was adjusted with citric acid to be 5.5, so that a coating liquid for lower backing layers was prepared.

(e)

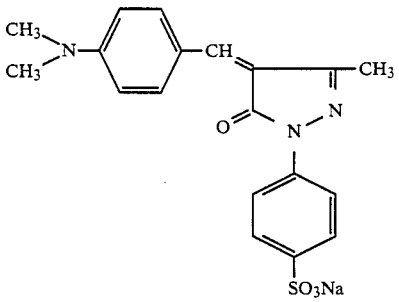

-continued (f)

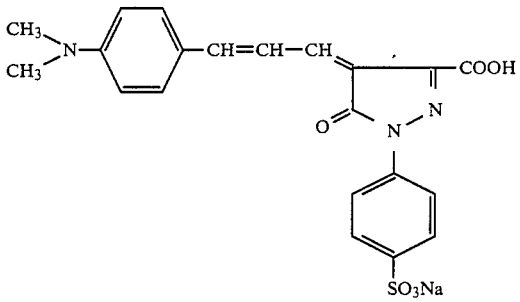

(g)

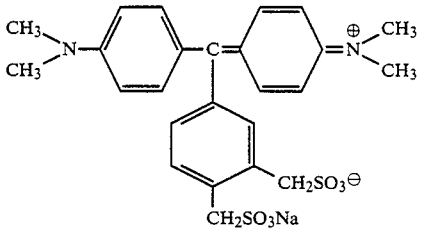

Preparation of Coating Liquid for Upper Backing Layer

Gelatin of 100 g were added with 1200 ml of water, and dissolved. The resulted solution was added with 50 g of silica having an average particle size of 3.5 μm as a matting agent, 3 g of saponin as a surfactant, 0.2 g of the above-given compound (c) and 1 g of glyoxal as a hardener, so that a coating liquid for upper backing layers was prepared. And, the pH of the coating liquid was 6.0.

Preparation of Samples

Onto a 100 μm thick polyethyleneterephthalate support which was subbed on both sides, both of the above-mentioned coating liquids for lower backing layer and for upper backing layer were simultaneously milti-coated and, on the opposite side of the backing layer, both of the above-mentioned coating liquids for emulsion layer and for protective layer were then simultaneously multi-coated, so that Samples No. 1 through No. 56 were prepared.

The amount of silver coated was 3.5 g/m$^2$. The amounts of gelatin added were 2.5 g/m$^2$ for the lower backing layer, 1 g/m$^2$ for the upper backing layer, 1.9 g/m$^2$ for the emulsion layer and 1.4 g/m$^2$ for the protective layer, respectively.

Evaluation of relative sensitivity and safe-light sensitivity

The resulted samples were evaluated in the same manner as in Example 1.

Evaluation of Retouchability and Erasability

As the above-mentioned samples remained unexposed to light, they were processed with an automatic processor, GR-26 manufactured by Konishiroku Photo Ind. Co., Ltd., in which the following developer and fixer were loaded, so that the samples for evaluation use were obtained.

As for the processing conditions, the development was made for 20 seconds at 40° C., the fixation was for 20 seconds at 35° C. and the washing was for 20 seconds at an ordinary temperature, respectively.

Next, the center-line average roughness of each surface of the samples was measure with a Perthometer Model S5P manufactured by Perthen Co., West Germany. The cut-off value and base length were set to be 0.8 mm and 4.8 mm, respectively, so that the measured value was obtained. Successively, the retouchability was evaluated by making use of a Rotring pen for drafting and a water-color ink.

The line density, density evenness and stability in line width were visually evaluated by making use of a magnifier of 10 times.

Results of Measurements

The results of measurements are shown in Table-3.

The more the center-line average roughness is, the more the retouchability may be improved. In this case, however, the density variations become serious after a safe light is applied and the safe light sensitivity is deteriorated. If the amount of the green spectrally sensitizing dye is so reduced as to restrain the density variations occurring after applying a safe light, the sensitivity is lowered.

On the other hand, in Samples No. 50 through No. 56 relating to the invention of which the protective layer was added with the dyes of the invention, the retouchability is excellent, the sensitivity is scarcely lowered and the density variations occurred after applying a safe light may be restrained.

TABLE 3

| Sample No. | Starch cont. of emulsion layers ($g/m^2$) | Silica cont. of protective layer ($g/m^2$) | Centerline average roughness ($\mu m$) | Green sensitizing dye | | Dye cont. of protective layer | | Retouchability | | | Relative sensitivity | Fog | Density variation after applying safelight | |
|---|---|---|---|---|---|---|---|---|---|---|---|---|---|---|
| | | | | Kind | Amount added (mg/mol Ag) | Kind | Amount added ($mg/m^2$) | Density | Evenness | Line width stability | | | | |
| 41 | — | 0.10 | 0.01 | II-23 | 200 | — | — | 2 | 2 | 2 | 100 | ≦0.01 | +0.30 | Comp. Sample |
| 42 | — | " | " | " | 150 | — | — | " | " | " | 60 | " | +0.21 | Comp. Sample |
| 43 | — | " | " | " | 100 | — | — | " | " | " | 40 | " | +0.10 | Comp. Sample |
| 44 | — | 0.50 | 0.30 | " | 200 | — | — | 4 | 4 | 4 | 100 | 0.01 | +0.33 | Comp. Sample |
| 45 | 0.50 | 0.50 | 0.50 | I-1 | 200 | — | — | 5 | 5 | 5 | 95 | 0.05 | +0.42 | Comp. Sample |
| 46 | " | " | " | II-39 | " | — | — | " | " | " | 100 | 0.03 | +0.36 | Comp. Sample |
| 47 | " | " | " | II-23 | " | — | — | " | " | " | 100 | 0.01 | +0.36 | Comp. Sample |
| 48 | " | " | " | " | 100 | — | — | " | " | " | 40 | 0.01 | +0.25 | Comp. Sample |
| 49 | " | " | " | " | 100 | — | — | " | " | " | 40 | 0.01 | +0.13 | Comp. Sample |
| 50 | " | " | " | " | " | III-1 | 40 | " | " | " | 93 | " | +0.09 | Sample of the invention |
| 51 | " | " | " | " | " | III-14 | 30 | " | " | " | 93 | " | +0.09 | Sample of the invention |
| 52 | " | " | " | " | " | III-1 | 40 | " | " | " | 98 | " | +0.06 | Sample of the invention |
| 53 | " | " | " | " | " | III-14 | 30 | " | " | " | 98 | " | +0.06 | Sample of the invention |
| 54 | " | " | " | " | 250 | III-1 | 40 | " | " | " | 110 | 0.01 | +0.18 | Sample of the invention |
| 55 | " | " | " | " | " | III-1 | 40 | " | " | " | 98 | 0.01 | +0.06 | Sample of the invention |
| 56 | " | " | " | " | " | III-14 | 30 | " | " | " | 98 | 0.01 | +0.06 | Sample of the invention |

In ranking. . . 5: Excellent, 4: Average, 3: 'Lowest acceptable' as a merchandise, 2: Poor, 1: Impossible to use

What is claimed is:

1. A silver halide photographic light-sensitive material comprising a support bearing thereon photographic component layers including at least one silver halide emulsion layer containing a silver halide emulsion sensitized so as to have a maximum spectral sensitivity on the side of a wavelength shorter than 600 nm; and at least one non-light-sensitive hydrophilic colloid layer arranged to the side of said silver halide emulsion layer opposite to said support, wherein at least one of said hydrophilic colloid layers contains a water-soluble dye having a maximum light-absorption within the wavelength region of not less than 700 nm.

2. The material of claim 1, wherein said water-soluble dye has a maximum absorbtion within the spectral region of from 700 nm to 800 nm.

3. The material of claim 1, said water-soluble dye represented by the following Formula IIIa, IIIb;

Formula IIIa

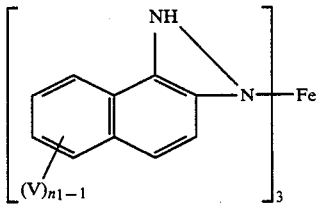

wherein V represents a sulfo group or a carboxy group; and $n_1$ represents an integer of 2, 3 or 4;

Formula IIIb

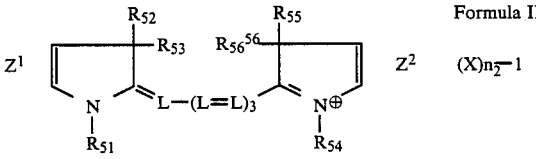

wherein $R_{51}$, $R_{52}$, $R_{53}$, $R_{54}$, $R_{55}$ and $R_{56}$ each represent an alkyl group, which may be the same with or the different from each other; $Z^1$ and $Z^2$ each represent a group of non-metal atoms necessary to complete a benzene ring or a naphthalene ring, provided that the groups represented by $R^{51}$, $R^{52}$, $R^{53}$, $R^{54}$, $R^{55}$, $R^{56}$, $Z^1$ and $Z^2$ contain at least three acid groups in total; L represents a methine group, X represents an anion and $n_2$ represents 1 or 2.

4. The material of claim 1, wherein said water-soluble dye is contained in said photographic component layers in an amount of from $10^{-3}$ g/m$^2$ to 1 g/m$^2$.

5. The material of claim 4, wherein said water-soluble dye is contained in said photographic component layers in an amount of from $10^{-3}$ g/m$^2$ to 0.5 g/m$^2$.

6. The material of claim 1, wherein said silver halide emulsion layer contains a spectral sensitizing dye represented by the following Formula I or Formula II;

Formula I

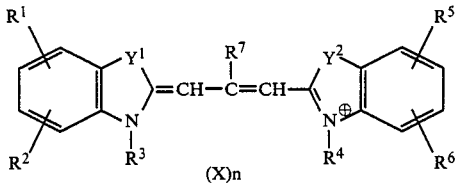

wherein $Y^1$ and $Y^2$ each represent an oxygen atom or an

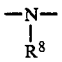

group; $R^1$, $R^2$, $R^5$, $R^6$ and $R^8$ each represent a hydrogen atom, a halogen atom, an alkyl halide group, a hydroxy group, a cyano group, a nitro group, an alkyl group, an alkoxy group, an aryl group, an alkenyl group, an acyl groyp, a sulfonyl group or an alkoxycarbonyl group; $R^3$ and $R^4$ represent an alkyl group, an alkenyl group or a aryl group; $R^7$ represents a hydrogenatom, a halogen atom, an alkyl group, an aryl group or a cyano group; X represents an anion; and n represents an integer of 0 or 1;

Formula II

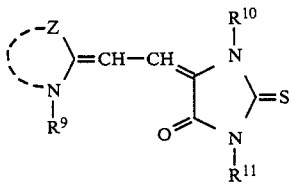

wherein Z represents a group of atoms necessary to complete an oxazole ring, a benzoxazole ring or a naphthoxazole ring; $R^9$ represents an alkyl group; $R^{10}$ represents an alkyl group, an alkoxycarbonylalkyl group, a hydroxyalkyl group, a hydroxyalkoxyalkyl group, a carbamoylalkyl group, a hydroxyphenyl group, a hydroxyalkylphenyl group or a substituent represented by $-(CH_2)n'-A$ or $-(CH_2)n'-O-(CH_2)n'-A$, in which A represents a nitrile group, a sulfoamido group or alkylsufonylamino group, and n' is an integer of 1 to 4; and $R^{11}$ represents an alkyl group having one to six carbon atoms, an alkoxy group or an alkylsulfon group each having one to six carbon atoms, a phenyl group or a pyridyl group.

7. The material of claim 1, wherein at least one of said photographic component layers contains a matting agent.

8. The material of claim 7, wherein the surface of said photographic component layers has a roughness within the range of from 0.15 μm to 0.8 μm in terms of center line average height.

9. The material of claim 8, wherein the surface of said photographic component layer has a roughness within the range of from 0.3 μm to 0.6 μm in terms of center line average hight.

* * * * *